US009598757B2

(12) United States Patent
Allely et al.

(10) Patent No.: US 9,598,757 B2
(45) Date of Patent: Mar. 21, 2017

(54) METAL SHEET WITH A ZNALMG COATING HAVING A PARTICULAR MICROSTRUCTURE, AND CORRESPONDING PRODUCTION METHOD

(71) Applicant: ARCELORMITTAL INVESTIGACION Y DESARROLLO, S.L., Sestao (ES)

(72) Inventors: Christian Allely, Maizieres-les-Metz (FR); Luc Diez, Metz (FR); Tiago Machado Amorim, Metz (FR); Jean-Michel Mataigne, Senlis (FR)

(73) Assignee: ARCELORMITTAL INVESTIGACIÓN Y DESARROLLO S.L., Sestao Bizkaia (ES)

( * ) Notice: Subject to any disclaimer, the term of this patent is extended or adjusted under 35 U.S.C. 154(b) by 0 days.

(21) Appl. No.: 14/766,344

(22) PCT Filed: Jul. 8, 2013

(86) PCT No.: PCT/IB2013/055575
§ 371 (c)(1),
(2) Date: Aug. 6, 2015

(87) PCT Pub. No.: WO2014/122507
PCT Pub. Date: Aug. 14, 2014

(65) Prior Publication Data

US 2015/0368778 A1 Dec. 24, 2015

(30) Foreign Application Priority Data

Feb. 6, 2013 (WO) ..... PCT/FR2013/050250

(51) Int. Cl.
*C23C 2/26* (2006.01)
*C23C 2/06* (2006.01)
(Continued)

(52) U.S. Cl.
CPC ..... *C23C 2/26* (2013.01); *C22C 18/04* (2013.01); *C23C 2/00* (2013.01); *C23C 2/04* (2013.01);
(Continued)

(58) Field of Classification Search
CPC C22C 18/04; C23C 2/06; C23C 30/00; C23C 2/28; C23C 28/00; C23C 2/26;
(Continued)

(56) References Cited

U.S. PATENT DOCUMENTS 3,505,043 A 4/1970 Lee et al.
2011/0111255 A1 5/2011 Diez et al.

FOREIGN PATENT DOCUMENTS

EP 1199376 4/2002
EP 1466994 10/2004
(Continued)

*Primary Examiner* — Michael E La Villa
(74) *Attorney, Agent, or Firm* — Davidson, Davidson & Kappel, LLC

(57) ABSTRACT

A metal sheet including a substrate having at least one face coated by a metallic coating is provided. The metallic coating has an aluminum content by weight $t_{Al}$ of between 3.6 and 3.8% a magnesium content by weight $t_{Mg}$ of between 2.7 and 3.3%. The coating has a microstructure comprising a lamellar matrix of eutectic ternary Zn/Al/$MgZn_2$ and possibly:

dendrites of Zn with an accumulated surface content exceeding 5.0%, flowers of binary eutectic of Zn/$MgZn_2$ with an accumulated surface content less than or equal to 15.0%, dendrites of binary eutectic Zn/Al surface with an accumulated surface content of less than 1.0% islets of $MgZn_2$ with an accumulated surface content below 1.0%.

17 Claims, 3 Drawing Sheets

(51) Int. Cl.

| | |
|---|---|
| ***C23C 2/00*** | (2006.01) |
| ***C23C 2/40*** | (2006.01) |
| ***C23C 2/12*** | (2006.01) |
| ***C22C 18/04*** | (2006.01) |
| ***C23C 2/04*** | (2006.01) |
| ***C23C 28/02*** | (2006.01) |
| ***C23C 30/00*** | (2006.01) |
| ***C23C 2/28*** | (2006.01) |
| ***C23C 28/00*** | (2006.01) |

(52) U.S. Cl.

CPC ..... *C23C 2/06* (2013.01); *C23C 2/12* (2013.01); *C23C 2/28* (2013.01); *C23C 2/40* (2013.01); *C23C 28/00* (2013.01); *C23C 28/021* (2013.01); *C23C 28/025* (2013.01); *C23C 30/00* (2013.01); *C23C 30/005* (2013.01); *Y10T 428/12556* (2015.01); *Y10T 428/12792* (2015.01); *Y10T 428/12799* (2015.01); *Y10T 428/12972* (2015.01); *Y10T 428/12979* (2015.01); *Y10T 428/12993* (2015.01)

(58) Field of Classification Search

CPC .... C23C 2/04; C23C 2/12; C23C 2/00; C23C 2/40; C23C 28/021; C23C 28/025; C23C 30/005; Y10T 428/12556; Y10T 428/12792; Y10T 428/12799; Y10T 428/12972; Y10T 428/12979; Y10T 428/12993

See application file for complete search history.

(56) References Cited

FOREIGN PATENT DOCUMENTS

| | | | |
|---|---|---|---|
| EP | 2119804 | | 11/2009 |
| WO | WO2012/091385 | * | 7/2012 |

* cited by examiner

METAL SHEET WITH A ZNALMG COATING HAVING A PARTICULAR MICROSTRUCTURE, AND CORRESPONDING PRODUCTION METHOD

The present invention relates to a metal sheet comprising a substrate having at least a face coated by a metal coating comprising Al and Mg, the remainder of the metal coating being Zn, and inevitable impurities and possibly one or more additional elements selected from among Si, Sb, Pb, Ti, Ca, Mn, Sn, La, Ce, Cr, Ni or Bi, wherein the content by weight of each additional element in the metal coating is less than 0.3%.

BACKGROUND

Metal galvanised coatings consisting essentially of zinc and 0.1 to 0.4% by weight of aluminium are traditionally used for their good protection against corrosion.

These metal coatings are now challenged especially by coatings comprising zinc, and magnesium and aluminium additions of respectively up to 10% and up to 20% by weight.

Such metal coatings are collectively referred to herein as aluminium-zinc-magnesium coatings or ZnAlMg.

The addition of magnesium significantly increases the corrosion resistance against red rust of these coatings, which enables a reduction in their thickness or an increase of the guarantee of protection against corrosion over time at constant thickness.

These sheets are intended, for example, for use in the automotive, electrical appliance or construction fields.

They can be added to paints before or after their finishing by users in these fields. When they are painted before finishing, they are called "pre-lacquered" sheets, wherein the latter are particularly intended for the electrical appliance or construction fields.

In the case of pre-lacquered sheets, the entire sheet metal fabrication method is implemented by the steelmaker, thus reducing the costs and constraints associated with the painting process at the user.

However, it is noted that known metal coatings may be prone to delamination problems of the paint layers, leading to local corrosion of the sheet.

SUMMARY OF THE INVENTION

An object of the invention is to provide a coated sheet, whose corrosion resistance is increased when it is painted.

The present invention provides a metal sheet comprising a substrate having at least one face coated by a metal coating comprising Al and Mg, the remainder of the metallic coating being Zn, unavoidable impurities and possibly one or more additional elements selected from among Si, Sb, Pb, Ti, Ca, Mn, Sn, La, Ce, Cr, or Bi, wherein the content by weight of each additional element in the metallic coating is less than 0.3%, the metal coating (7) having an aluminium content by weight $t_{Al}$ of between 3.6 and 3.8% and a magnesium content by weight $t_{Mg}$ of between 2.7 and 3.3%, the metal coating having a microstructure comprising a lamellar matrix of ternary eutectic of $Zn/Al/MgZn_2$ and optionally:

- dendrites of Zn with an accumulated surface content at the outer surface of the coating in the raw state of less than or equal to 5.0%,
- flowers of binary eutectic of $Zn/MgZn_2$ with an accumulated surface content at the outer surface of the coating in the raw state of less than or equal to 15.0%,
- dendrites of binary eutectic of Zn/Al with an accumulated surface content at the outer surface of the metal coating in the raw state of less than or equal to 1.0%,
- islets of $MgZn_2$ with an accumulated surface content at the outer surface of the coating in the raw state of less than or equal to 1.0%.

BRIEF DESCRIPTION OF THE DRAWINGS

The invention will now be illustrated by examples given for information only, and without limitation, with reference to the accompanying figures, wherein.

DETAILED DESCRIPTION

Figure 1:
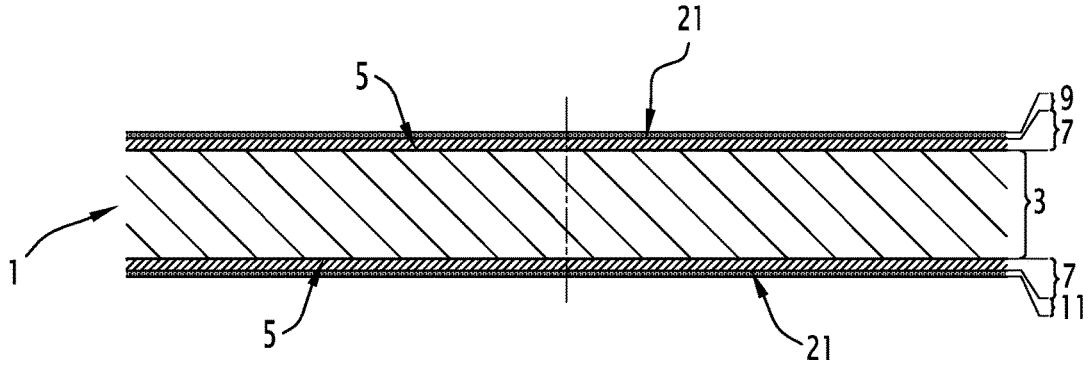
FIG. 1 shows a schematic sectional view illustrating the structure of a sheet according to the invention after painting.

Sheet 1 of FIG. 1 comprises a steel substrate 3 covered on each of its two faces 5 by a metal coating 7, which is itself covered by a film of paint 9, 11.

One notes that the relative thicknesses of the substrate 3 and the various layers covering it have not been respected in FIG. 1 in order to facilitate the representation.

The coatings 7 present on the two faces 5 are similar and only one will be described in detail below. Alternatively, (not shown), only one face 5 has a coating 7.

The coating 7 generally has a thickness less than or equal to 25 μm and is intended to protect the substrate 3 against corrosion.

The coating 7 comprises zinc, aluminium and magnesium. The aluminium content by weight tAl of the metal coating 7 is between 3.6 and 3.8%. The magnesium content by weight tMg of the metal coating 7 is between 2.7 and 3.3%.

Preferably, the magnesium content tMg is between 2.9 and 3.1%.

Preferably, the weight ratio Al/(Al+Mg) is greater than or equal to 0.45, or even greater than or equal to 0.50, or even greater than or equal to 0.55.

Figure 2:
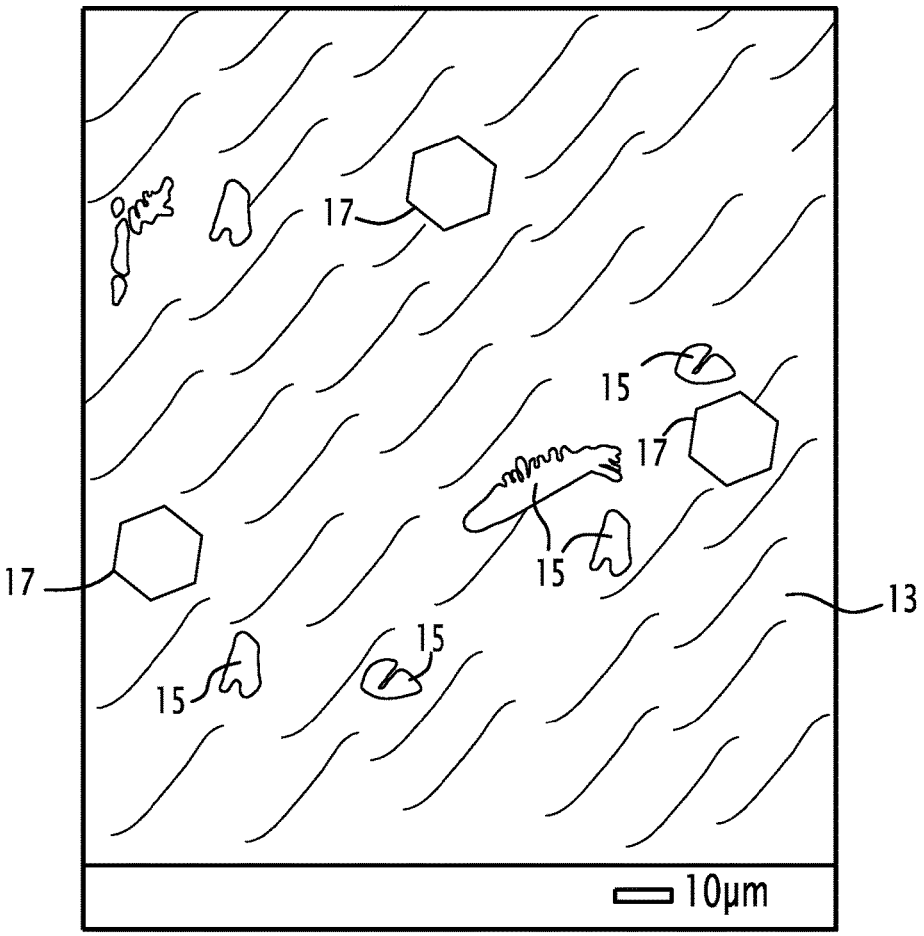
FIGS. 2 to 4 are schematics showing the microstructure of the surface of the unprocessed metal coatings of the sheet of FIG. 1.
Figure 3:
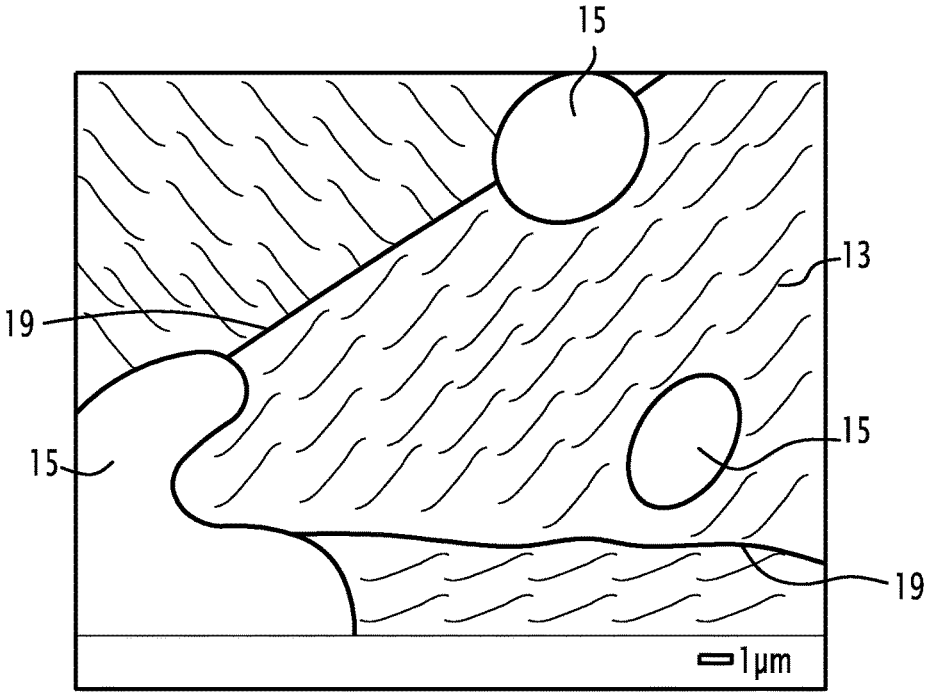
Figure 4:
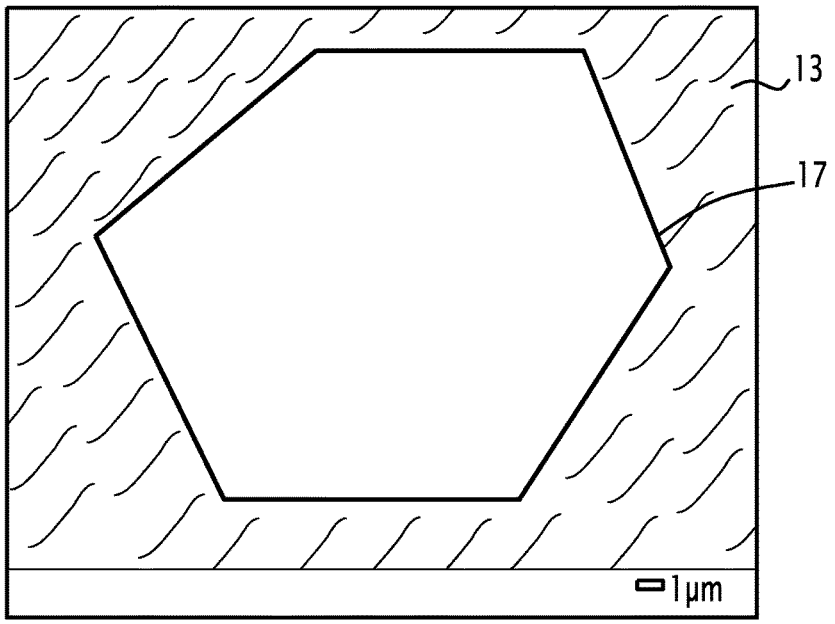

As illustrated in FIGS. 2 to 4, the coating 7 has a particular microstructure with a lamellar matrix 13 of ternary eutectic Zn/Al/MgZn2. As seen in FIG. 3, the lamellar matrix 13 forms grains separated by joints 19.

In a preferred form of the invention, the ternary eutectic constitutes the entire microstructure of the coating.

The interlamellar distance of the lamellar matrix 13 may vary quite strongly in its grains, especially near structures possibly encompassed by this matrix, whose structures will now be described.

Apart from the lamellar matrix 13 mentioned above, the microstructure at the surface and in cross-section, may comprise small amounts of dendrites 15 of Zn and flowers 17 of binary eutectic Zn/MgZn2, which are not too detrimental to the improved delamination resistance obtained according to the invention.

To achieve this, the accumulated surface contents of dendrites 15 of Zn and flowers 17 of binary eutectic Zn/MgZn2 are limited to the outer surface 21 in the raw state.

Preferably, the accumulated surface content of dendrites 15 of Zn at the outer surface 21 in the raw state is less than 5.0% or even 3.0% or even 2.0% or even 1.0%, and most preferably zero, while the accumulated surface content of flowers 17 of binary eutectic Zn/MgZn2 at the outer surface 21 in the raw state, is less than 15.0% or even 10.0% or even 5.0% or even 3.0% and ideally zero.

The microstructure may also include dendrites of binary eutectic Zn/Al or islets of MgZn2 in very small quantities because these structures strongly deteriorate the resistance to delamination of sheets coated according to the invention.

In any event, the accumulated surface content of dendrites of binary eutectic Zn/Al at the outer surface 21 in the raw state is less than 1.0%, while the accumulated surface content of islets of MgZn2 at the outer surface 21 in the raw state is less than 1.0% and the combined contents are preferably zero.

Similarly, the respective accumulated contents in cross section, of dendrites of binary eutectic Zn/Al, while MgZn2 islets are preferably zero.

Thus, in general, the microstructure comprises a lamellar matrix 13 of ternary eutectic and possibly dendrites 15 of Zn, flowers 17 of binary eutectic Zn/MgZn2, dendrites of binary eutectic Zn/Al and islets of MgZn2. However, depending on the presence of additional optional elements mentioned below, the microstructure may also comprise small amounts of other structures encompassed in the lamellar matrix 13 of ternary eutectic.

The accumulated surface contents for each structure are, for example, measured by taking at least 30 frames with a ×1000 magnification of the outer surface 21 in the raw state (i.e., without polishing but optionally degreased by organic solvent) using a scanning electron microscope.

For each of these frames, one extracts the contours of the structure whose content is to be measured, and then calculates, for example, with the software AnalySIS Docu 5.0 from Olympus Soft Imaging Solutions GmbH, the occupancy rate of the outer surface 21 by the structure in question. The occupancy rate is calculated as the accumulated surface content of the structure in question.

The paint films 9 and 11 are, for example, based on polymers. These polymers may be polyesters or halogenated vinyl polymers such as plastisols, PVDF . . . .

The films 9 and 11 typically have thicknesses between 1 and 200 μm.

To make the sheet 1, one can, for example, take the following steps.

The installation used may comprise a single line or, for example, two different lines in order to respectively carry out the metal coating and the painting. In the event that two different lines are used, they may be located on the same site or on different sites. In the following description, by way of example, a variant was considered where two separate lines are used.

In a first line to carry out the metal coating 7, one uses a substrate 3, obtained for example by hot lamination and then cold lamination. The substrate 3 is in the form of a band that one scrolls through a bath to deposit coatings 7 by hot dipping.

The bath is a bath of molten zinc containing magnesium and aluminium. The bath may also contain up to 0.3% by weight of additional optional elements such as Si, Sb, Pb, Ti, Ca, Mn, Sn, La, Ce, Cr, Ni or Bi.

These additional elements enable, among other things, the improvement of the ductility and the adhesion of coatings 7 on the substrate 3. The person skilled in the art who knows their effects on the characteristics of coatings 7 will use them as a function of the sought-after aim. Finally, the bath may contain residual elements coming from the supply ingots or resulting from the passage of the substrate 3 in the bath, such as iron in an amount up to 0.5% by weight and generally between 0.1 and 0.4% by weight.

The bath has a temperature Tb between 360° C. and 480° C., preferably between 420° C. and 460° C.

At the entrance of the bath, the substrate 3 has an immersion temperature Ti such that:

$$(2.34\times t\mathrm{Al}+0.655\times t\mathrm{Mg}-10{,}1)\times 10-6<\exp(-10584/Ti)$$

where Ti is expressed in degrees Kelvin.

Such an immersion temperature Ti allows one to obtain the above microstructure with little or no structure encompassed in the lamellar matrix 13.

Generally, this temperature Ti is determined on site from a measurement taken a few meters upstream from the bath by a pyrometric technique and then application of a thermal model to calculate the temperature Ti.

To vary Ti and satisfy the above equation, one modifies the conditions for cooling the substrate 3 upstream of the bath. This cooling may be achieved by blowing inert cooling gas on the two surfaces 5 of the substrate 3 by means of cooling chambers, whose gas pressure can be regulated. It is also possible to adjust the scrolling speed of the substrate 3 in the cooling zone or even the temperature of the substrate 3 at the entrance to this zone, for example.

After deposition of the coatings 7, the substrate 3 is for example dewatered by means of nozzles spraying a gas on either side of the substrate 3.

Then one allows the coatings 7 to cool in a controlled manner so that they solidify.

Alternatively, brushing may be carried out to remove the coating 7 deposited on a surface 5 so that only one of the faces 5 of the sheet 1 will ultimately be coated with a coating 7.

Controlled cooling of the, or of each, coating 7 is provided at a higher speed or preferably equal to 15° C./s between the start of the solidification (i.e. when the temperature of the coating 7 falls just below the liquidus temperature) and the end of solidification (i.e. when the coating 7 reaches the solidus temperature). More preferably, the cooling rate of the, or each, coating 7 between the start of the solidification and the end of solidification is higher than or equal to 20° C./s.

The band thus treated may then be subjected to a so-called skin-pass step which allows it to work-harden and give it a roughness facilitating its subsequent finishing.

The band may optionally be wound before being sent to a pre-lacquering line.

The outer surfaces 21 of the coatings 7 are possibly subject to a degreasing step and optionally a surface treatment step in order to increase the paint adhesion and corrosion resistance.

Any degreasing and surface treatment steps may include other sub-steps such as rinsing, drying . . . .

The painting process can then be performed, for example, by deposition of two successive layers of paints, namely a primary layer and a finishing layer which is generally the case to achieve the upper film 9, or by deposition of a single layer of paint, which is generally the case to achieve the lower film 11. Other numbers of layers can be used in some variants.

The deposition of layers of paint may be provided, for example, by roller coaters.

Each deposition of a layer of paint is generally followed by a baking step in an oven.

The sheet 1 thus obtained can be wound again before being cut, possibly finished and assembled by users with other sheets 1 or other items.

Test 1

One prepares a sample sheet 1 according to the invention and samples of sheets not according to the invention by varying the Ti immersion temperature and the tAl and tMg of the samples. The corresponding microstructures are analysed to determine the existing structures and their accumulated surface contents.

Figure 6:
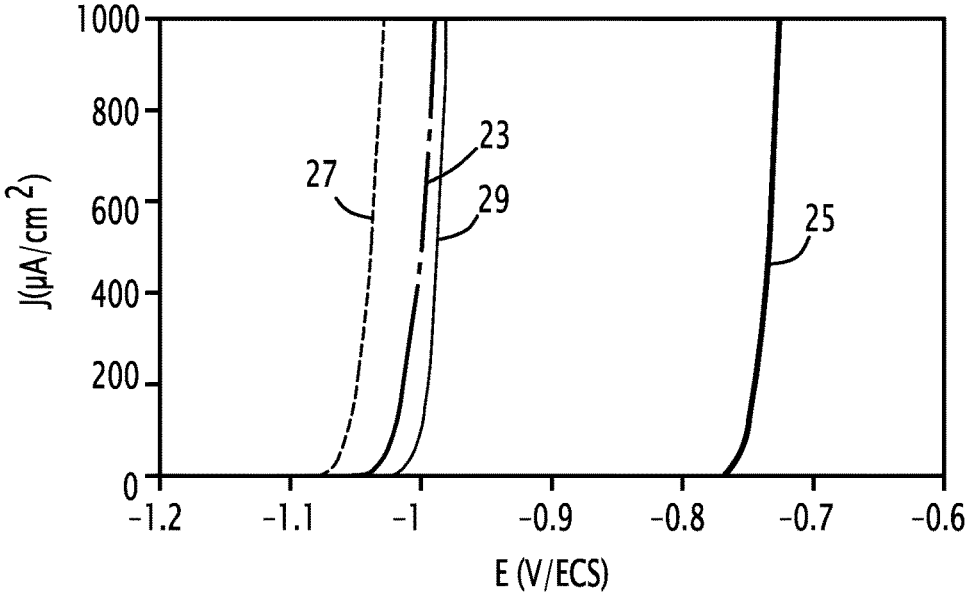
FIG. 6 is a schematic showing current density curves and the corrosion potential of various phases.

In FIG. 6, the corrosion potential relative to a reference calomel electrode saturated in KCl (SCE) is shown on the abscissa and the current density on the ordinate. Curve 23 corresponds to a composition comprising 3.7% by weight of Al and 3.0 mass % of Mg, wherein the balance is Zn. This curve is representative of the lamellar matrix 13.

FIG. 6 shows that the risk of corrosive coupling of the lamellar matrix 13 is greater with structures containing Al (curve 25), Mg (curve 27) and Zn (curve 29).

In general, the sheets 1 according to the invention are not necessarily marketed in the form of paint ("pre-lacquered" sheets) and/or may be coated with at least a layer of oil.

| | | | | Microstructure of the coating - accumulated surface contents | | | | |
|---|---|---|---|---|---|---|---|---|
| Test | $t_{Al}$ (%) | $t_{Mg}$ (%) | Ti (K) | Ternary eutectic (%) | Dendrites of Zn (%) | Flowers of binary eutectic $Zn/MgZn_2$ (%) | Dendrites of binary eutectic Zn/Al (%) | Islets of $MgZn_2$ (%) |
| 1* | 3.7 | 3.0 | 753 | 100 | 0 | 0 | 0 | 0 |
| 2 | 3.7 | 3.0 | 713 | 95 | 0 | 0 | 5 | 0 |
| 3* | 3.7 | 3.3 | 753 | 100 | 0 | 0 | 0 | 0 |
| 4 | 3.7 | 3.3 | 713 | 80 | 0 | 15 | 0 | 5 |

*According to the invention

Test 2

One subjects to delamination tests, a sample of sheet 1 according to the invention and sheets not according to the invention to measure their resistance to corrosion under paint.

More precisely, the sheets tested have coating thicknesses of 8 μm.

The composition of the coatings 7 of the sheets 1 according to the invention have a tAl content of 3.7% and a tMg content of 3.0%. As indicated in the axis of the abscissa in FIG. 5, other coating compositions tested had tAl values of 0.3%, 1.5%, 6.0% and 11.0%, and tMg values of 10%, 1.5%, 3.0 and 3.0%.

The microstructure of the sheet according to the invention consists solely of ternary eutectic and is obtained by immersion in a coating bath at a temperature Tb=460° C., wherein the strip has a temperature Ti=480° C.

The corrosion tests are in accordance with VDA 621-415 (10 cycles).

More precisely, the sheets tested are phosphated, coated with a layer of cataphoresis and scratched to the substrate with a 1 mm wide blade.

Figure 5:
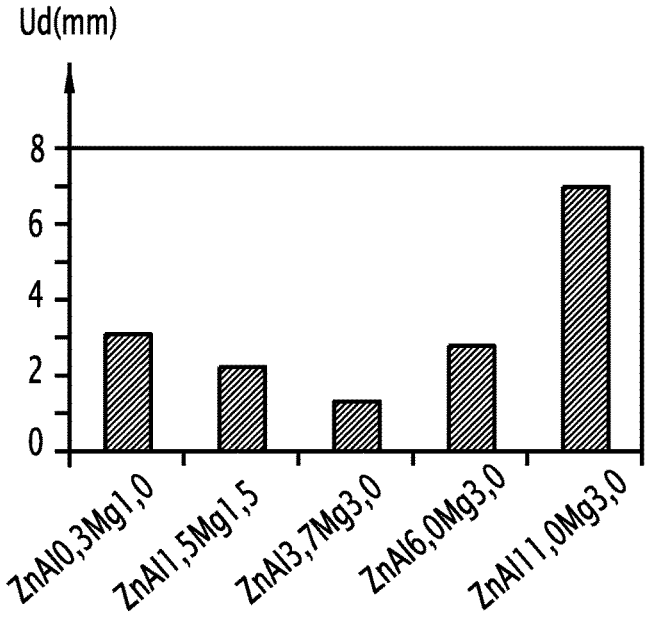
FIG. 5 is a schematic showing the results of delamination tests conducted on a sample plate according to the invention compared with sheets which are not according to the invention.

The maximum delamination widths Ud measured in mm after the corrosion tests for various test plates are given on the ordinate in FIG. 5.

As can be seen, the delamination widths are optimal for the sheet according to the invention.

Entirely surprisingly, it is found that increasing the associated contents of aluminium and magnesium beyond the values of the invention, deteriorates the resistance to delamination and hence to corrosion.

The inventors currently believe that this good resistance to corrosion under paint is due to the particular microstructure of the coatings 7 which limits the risk of electrical coupling between their different structures and the lamellar matrix 13.

Due to the low presence of structures encompassed in the lamellar matrix 13 on the outer surface 21 of each coating 7, the risk of selective dissolution of these phases is, in fact, reduced.

What is claimed is:

1. Metal sheet comprising:

a substrate; and a metal coating including Al and Mg, the remainder of the metallic coating being Zn and unavoidable impurities, the metal coating having an aluminium content by weight $t_{Al}$ of between 3.6 and 3.8% and a magnesium content by weight $t_{Mg}$ of between 2.7 and 3.3%, the substrate having at least one face coated by the metal coating, the metal coating having a microstructure comprising:

a lamellar matrix of ternary eutectic of $Zn/Al/MgZn_2$;

an accumulated surface content of dendrites of Zn at the outer surface of the coating in the raw state in the amount of from 0 to 5.0%;

an accumulated surface content of flowers of binary eutectic of $Zn/MgZn_2$ at the outer surface of the coating in the raw state in the amount of from 0 to 15.0%;

an accumulated surface content of dendrites of binary eutectic of Zn/Al at the outer surface of the metal coating in the raw state in the amount of from 0 to less than 1.0%; and an accumulated surface content of islets of $MgZn_2$ at the outer surface of the coating in the raw state in the amount of from 0 to less than 1.0%.

2. Metal sheet according to claim 1, wherein the $t_{Mg}$ magnesium content is between 2.9 and 3.1%.

3. Metal sheet according to claim 1, wherein a weight ratio Al/(Al+Mg) is greater than or equal to 0.55.

4. Metal sheet according to claim 1, wherein, in the microstructure, there is no accumulated surface content of dendrites of binary eutectic Zn/Al at the outer surface of the coating in a raw state.

5. Metal sheet according to claim 1, wherein, in the microstructure, there is no accumulated surface content of islets of $MgZn_2$ at the outer surface of the coating in a raw state.

6. Metal sheet according to claim 1, wherein the accumulated surface content of the flowers of binary eutectic $Zn/MgZn_2$ at the outer surface of the coating in a raw state is less than 10.0%.

7. Metal sheet according to claim 6, wherein the accumulated surface content of the flowers of binary eutectic $Zn/MgZn_2$ at the outer surface of the coating in a raw state is less than 5.0%.

8. Metal sheet according to claim 1, wherein the accumulated surface content of the flowers of binary eutectic $Zn/MgZn_2$ at the outer surface of the coating in a raw state is less than 3.0%.

9. Metal sheet according to claim 8, wherein the accumulated surface content of dendrites of Zn at the outer surface of the coating in a raw state is less than 2.0%.

10. Metal sheet according to claim 9, wherein the accumulated surface content of dendrites of Zn at the outer surface of the coating in a raw state is less than 1.0%.

11. Metal sheet according to claim 1, wherein the microstructure consists of the lamellar matrix of ternary eutectic of $Zn/Al/MgZn_2$.

12. Metal sheet according to claim 1, wherein the metal coating is covered with at least a paint layer and/or an oil layer.

13. Metal sheet according to claim 1, wherein the metal coating includes one or more additional elements selected from among: Si, Sb, Pb, Ti, Ca, Mn, Sn, La, Ce, Cr, or Bi, and wherein a content by weight of each additional element in the metallic coating is less than 0.3%.

14. Metal sheet according to claim 1, wherein, in the microstructure, an accumulated surface content of dendrites of binary eutectic of Zn/Al at an outer surface of the metal coating in the raw state is from 0 to less than 1.0%.

15. Method of making a metal sheet according to claim 1, wherein the method comprises at least the steps of:

providing a substrate of steel, depositing a metallic coating on at least one face of the substrate by quenching the substrate in a bath, wherein the substrate has an immersion inlet temperature Ti at the entrance in the bath such that $(2.34\times t_{Al}+0.655\times t_{Mg}-10.1)\times 10^{-6}\leq \exp(-10584/Ti)$ where Ti is in degrees Kelvin, and solidifying the metal coating.

16. Production method according to claim 15, wherein a rate of cooling the coating between a start of solidification and an end of solidification is greater than or equal to 15° C./s.

17. Production method according to claim 16, wherein the rate of cooling the coating between the start of solidification and the end of solidification is greater than or equal to 20° C./s.

* * * * *